US008408834B2

(12) United States Patent
Wang

(10) Patent No.: US 8,408,834 B2
(45) Date of Patent: Apr. 2, 2013

(54) PAINT APPLICATOR CAPABLE OF CONTROLLING AMOUNT OF PAINT RELEASED

(76) Inventor: Miguel Wang, Taichung (TW)

( * ) Notice: Subject to any disclaimer, the term of this patent is extended or adjusted under 35 U.S.C. 154(b) by 0 days.

(21) Appl. No.: 13/366,343

(22) Filed: Feb. 5, 2012

(65) Prior Publication Data

US 2012/0163899 A1 Jun. 28, 2012

Related U.S. Application Data

(63) Continuation-in-part of application No. 12/572,642, filed on Oct. 2, 2009, now abandoned.

(51) Int. Cl.
*A46B 11/04* (2006.01)

(52) U.S. Cl. ..... 401/291; 401/283; 401/197

(58) Field of Classification Search ..... 401/265, 401/266, 282, 283, 284, 289, 291, 197
See application file for complete search history.

(56) References Cited

U.S. PATENT DOCUMENTS 5,033,898 A * 7/1991 Williams ..... 401/283
6,682,246 B2 * 1/2004 Reggiani ..... 401/264

* cited by examiner

*Primary Examiner* — David Walczak

(57) ABSTRACT

A paint applicator is provided with a handle formed with a paint-entry passage, a first housing half connected to the handle, a second housing half jointed to the first housing half and formed with a plurality of paint exit holes, a non-permeable resilient body disposed on the second housing half and formed with a plurality of apertures, a permeable foamed body, and a brush layer. The apertures are closed in normal conditions and will be opened under pressure. Paint is accumulated in a paint chamber between the first and second housing halves, and then will flow out only when the paint pressure is greater than a deformation threshold value of the non-permeable resilient body. Furthermore, since the apertures are very small and can be evenly and densely distributed over the resilient body, paint will be evenly permeated to the permeable foamed body and the brush layer.

2 Claims, 6 Drawing Sheets

PAINT APPLICATOR CAPABLE OF CONTROLLING AMOUNT OF PAINT RELEASED

This application is a continuation in part of U.S. patent application Ser. No. 12/572,642, which claims the benefit of the earlier filing date of Oct. 2, 2009 now abandoned. Claims 1-2 of this application are revised from claim 1 of the U.S. patent application Ser. No. 12/572,642.

BACKGROUND OF THE INVENTION

1. Field of the Invention

The present invention relates to a paint brush, and more particularly to a paint applicator capable of controlling amount of paint released.

2. Description of the Prior Art

A conventional paint applicator 10 as shown in FIG. 1 comprises: a hollow handle 11, a base 12, a cylindrical outer housing 13, and a brush layer 14. The hollow handle 11 is formed with a paint-entry passage 111. The base 12 is connected to the hollow handle 11, the cylindrical outer housing 13 is sleeved on the base 12, and the brush layer 14 covers the cylindrical outer housing 13. The base 12 is provided in its peripheral surface with a plurality of first paint exit holes 121, and the cylindrical outer housing 13 is formed with a plurality of second paint exit holes 131 which are aligned with the first paint exit holes 121.

The paint is fed into the hollow handle 11 and flows to the base 12. When the first paint exit holes 121 are aligned with the second paint exit holes 131, the paint can flow from the second paint exit holes 131 of the cylindrical outer housing 13 to the brush layer 14, and finally coated onto an object surface by the brush layer 14. However, once the first paint exit holes 121 are aligned with the second paint exit holes 131, a large number of the paint will continuously flush into the brush layer 14 from the second paint exit holes 131 until there is no paint left in the hollow handle 11.

If the paint is continuously poured into the hollow handle, the greater the flow of the poured paint (namely, the greater the pressure of the poured paint), the correlation between the amount of paint released and the paint pressure is as shown in FIG. 2, wherein the line L1 is an ideal line showing an ideal state in which the paint amount is proportional to the paint pressure. The line L2 is a real line showing the real correlation between the amount of the paint released from the paint applicator 10 and the paint pressure. When the first paint exit holes 121 are aligned with the second paint exit holes 131, a large amount of paint will flush to the brush layer 14 instantly, and the greater the pressure of the paint, the greater the flow velocity of the paint, so that the brush layer 14 will be saturated with the paint in a very short time. As a result, the paint cannot be evenly distributed in the brush layer 14, and therefore cannot be evenly applied to the object to be painted. Besides, the user is unable to control the amount of the paint released from the paint applicator.

The present invention has arisen to mitigate and/or obviate the afore-described disadvantages.

SUMMARY OF THE INVENTION

The primary object of the present invention is to provide a paint applicator capable of controlling amount of paint released, wherein the paint can be applied more evenly, and the operability of the paint applicator is improved.

To achieve the above object, a paint applicator provided by the present invention comprises: a handle, a first housing half, a second housing half, a non-permeable resilient body, a permeable foamed body, and a brush layer.

The handle is formed with a paint-entry passage that extends along a length thereof.

The first housing half is connected to an end of the handle.

The second housing half is jointed to the first housing half and formed with a receiving concave that cooperates with the first housing half to form a paint chamber, and at a bottom of the receiving concave is formed a plurality of paint exit holes.

The non-permeable resilient body is disposed on the second housing half and formed with a plurality of apertures which are 0.005-0.01 cm in diameter. The apertures are closed in normal conditions and abutted against the paint exit holes of the second housing half. The non-permeable resilient body is deformable only when a pressure applied to the non-permeable resilient body is greater than a deformation threshold value.

The permeable foamed body is abutted against the non-permeable resilient body.

The brush layer is abutted against the permeable foamed body.

With the arrangement of the paint exit holes and the apertures, paint can be accumulated in the paint chamber, and then will flow out only when the paint pressure is greater than the deformation threshold value of the non-permeable resilient body. Furthermore, since the apertures of the non-permeable resilient body are very small and can therefore be evenly and densely distributed over the non-permeable resilient body, paint will be evenly permeated to the permeable foamed body and the brush layer.

DETAILED DESCRIPTION OF THE PREFERRED EMBODIMENTS

Figure 1:
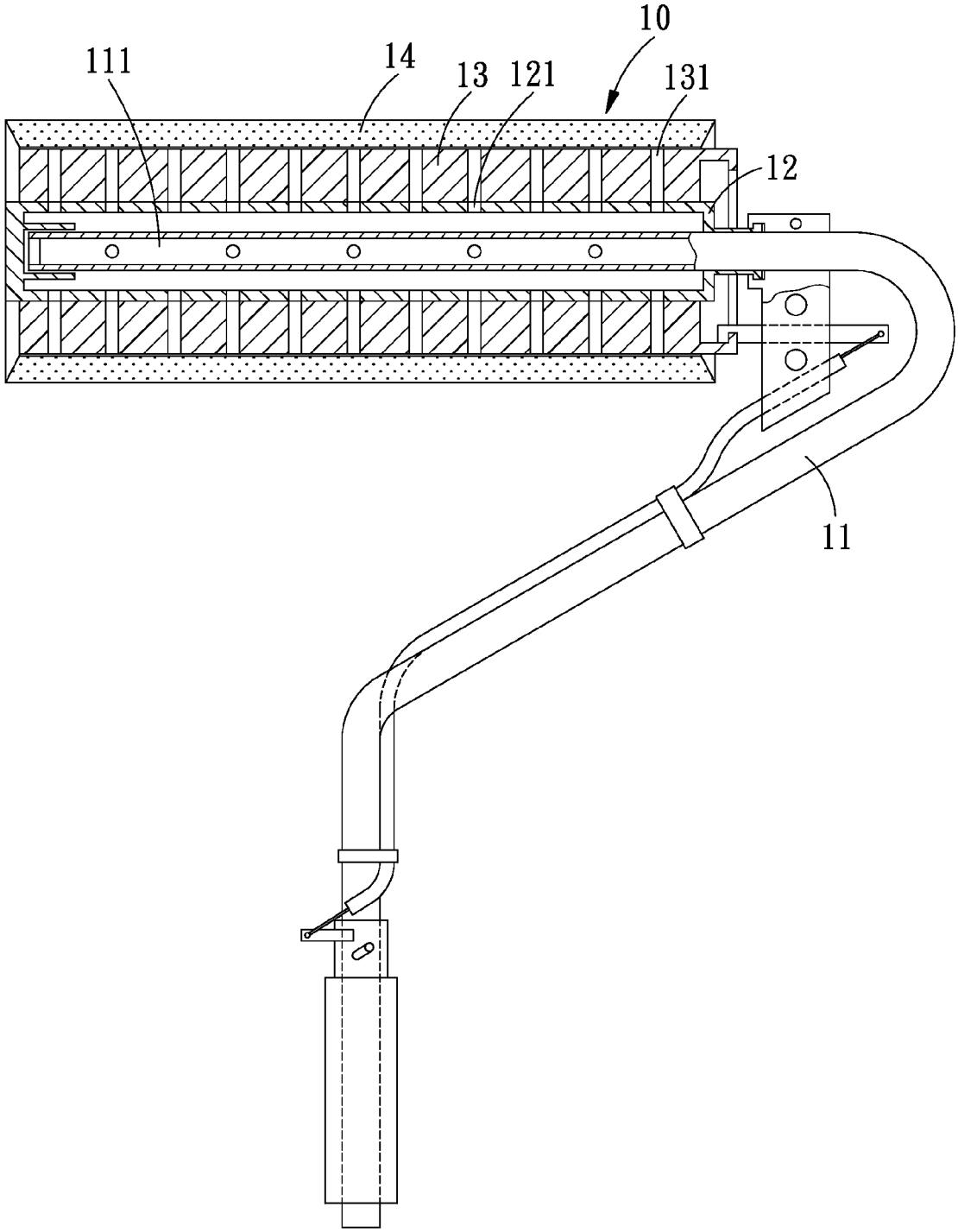
FIG. 1 PRIOR ART
FIG. 1 is a cross sectional view of a conventional paint applicator.
Figure 2:
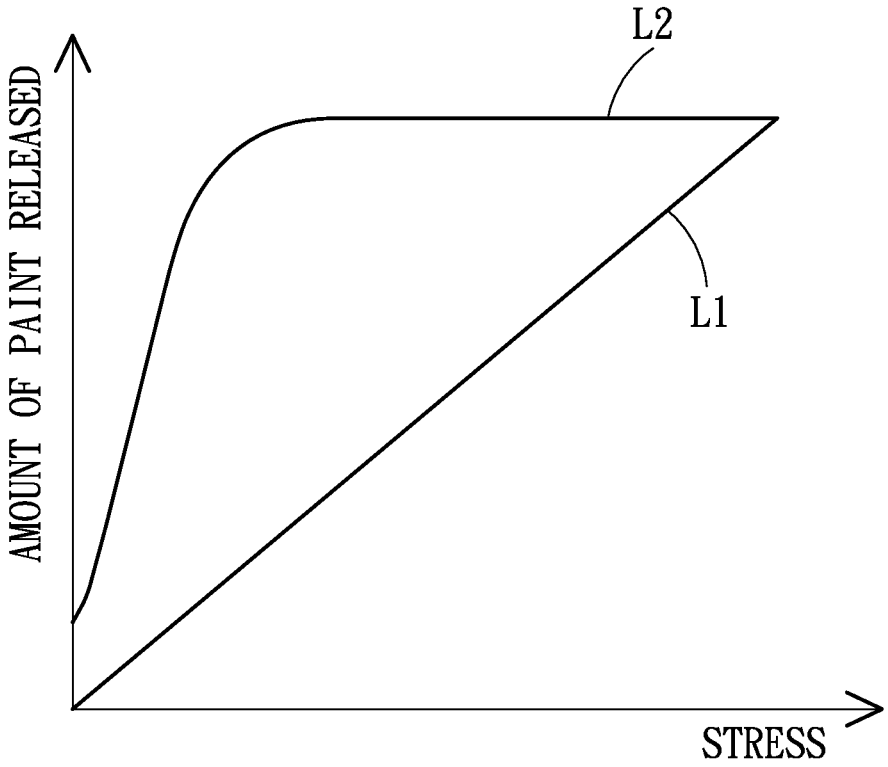
FIG. 2 PRIOR ART
FIG. 2 shows the correlation between the amount of paint released and the paint pressure.
Figure 3:
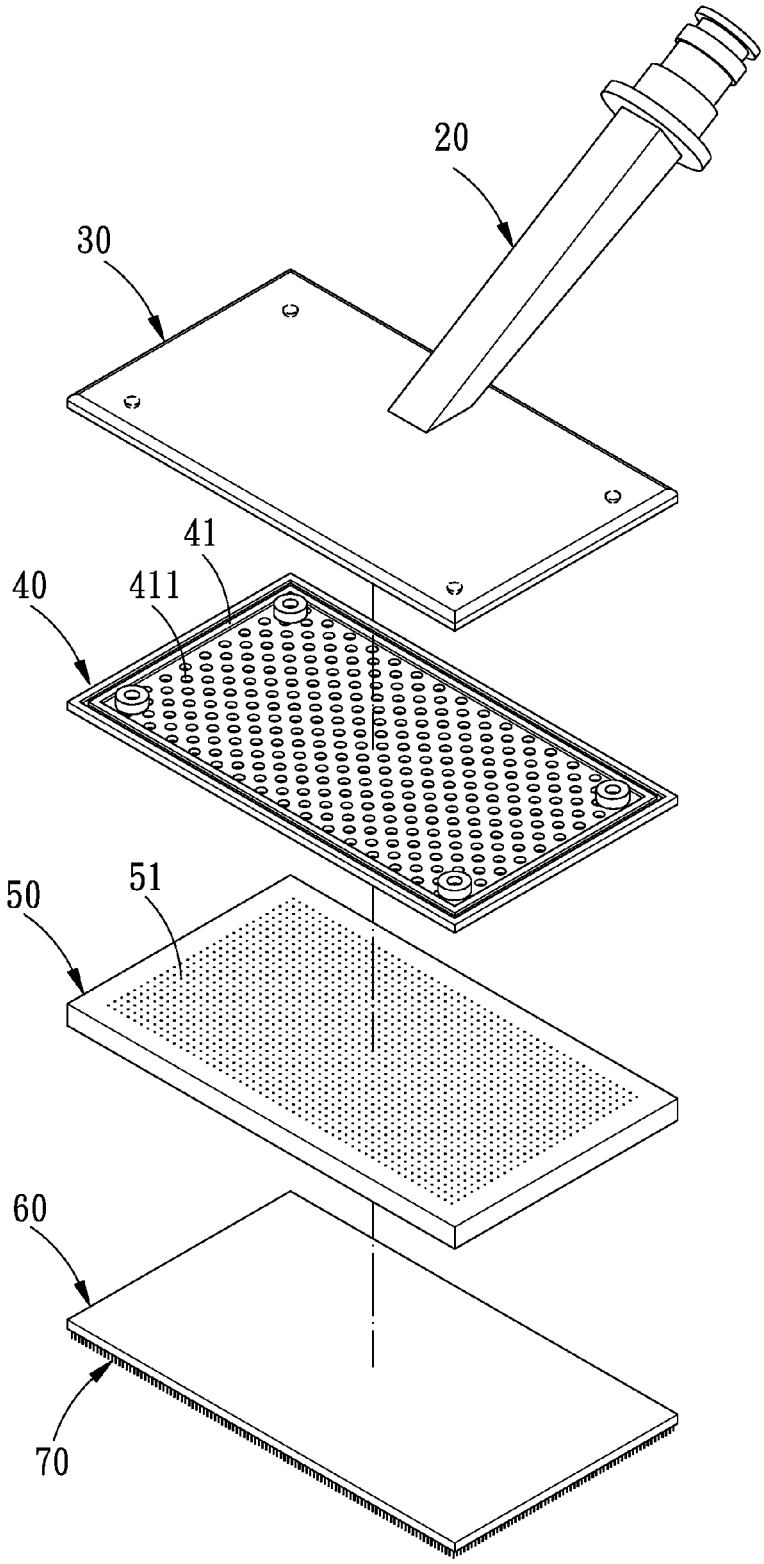
FIG. 3 is an exploded view of a paint applicator in accordance with the present invention.
Figure 4:
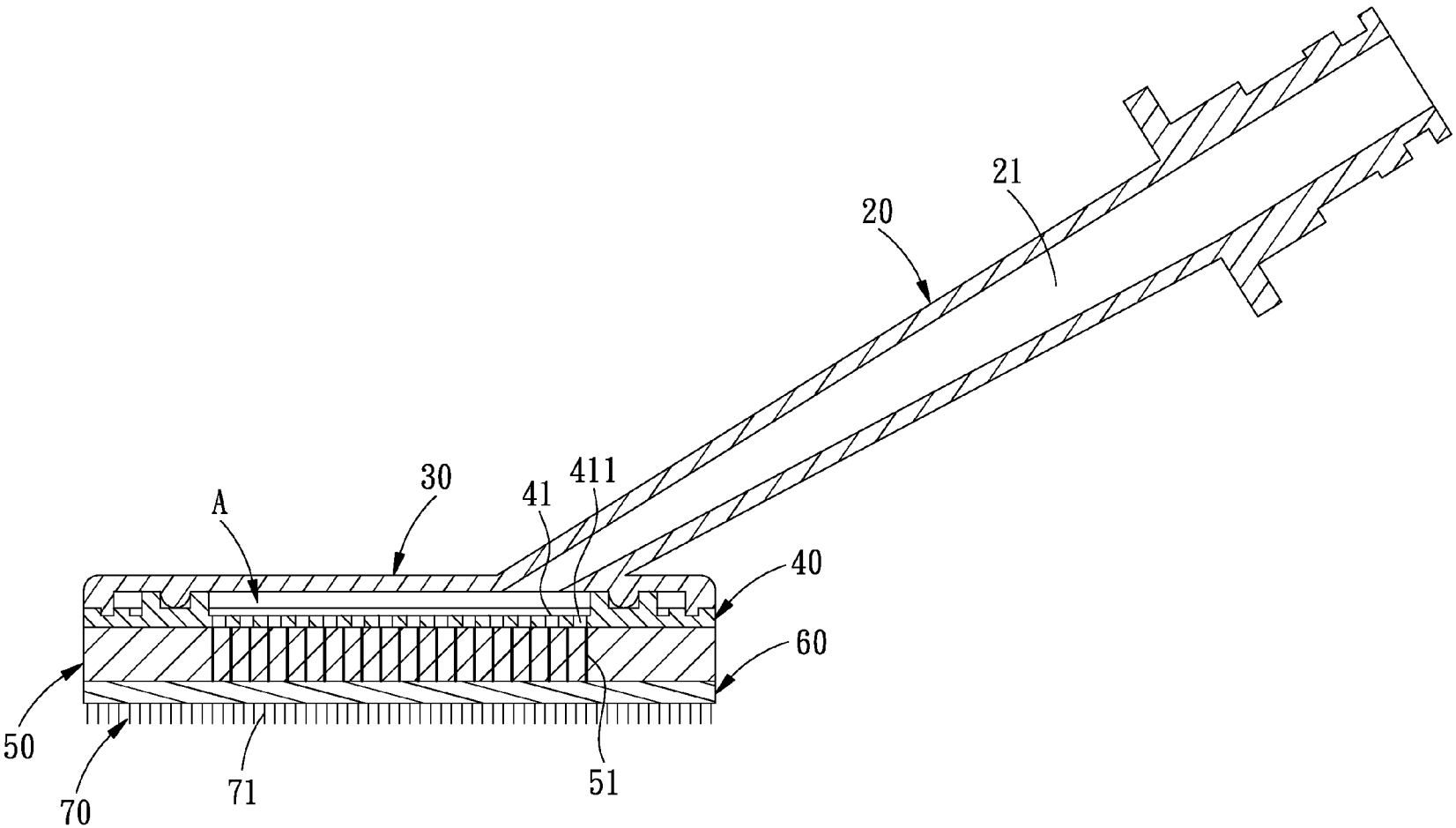
FIG. 4 is a cross sectional view of the paint applicator in accordance with the present invention.

The present invention will be clearer from the following description when viewed together with the accompanying drawings, which show, for purpose of illustrations only, the preferred embodiment in accordance with the present invention.

Referring to FIGS. 4-7, a paint applicator capable of controlling amount of paint released comprises: a hollow handle 20, a first housing half 30, a second housing half 40, a non-permeable resilient body 50, a permeable foamed body 60 and a brush layer 70.

The handle 20 is formed with a paint-entry passage 21 that extends along the length thereof.

The first housing half 30 is connected to an end of the handle 20.

The second housing half 40 is jointed to the first housing half 30 and is formed with a receiving concave 41 that cooperates with the first housing half 30 to form a paint chamber A, and at the bottom of the receiving concave 41 is formed a plurality of paint exit holes 411.

The non-permeable resilient body 50 is disposed on the second housing half 40 and formed with a plurality of apertures 51 which are 0.005-0.01 cm in diameter. The apertures 51 are closed in normal conditions and abutted against the paint exit holes 411 of the second housing half 40. In this embodiment, the non-permeable resilient body 50 is a foamed body. To make the non-permeable resilient body 50 produce elastic deformation, the pressure applied to the non-permeable resilient body 50 must be greater than a deformation threshold value.

The permeable foamed body 60 is abutted against the non-permeable resilient body 50.

The brush layer 70 is abutted against the permeable foamed body 60, and in this embodiment, composed of a plurality of bristles 71.

Figure 5:
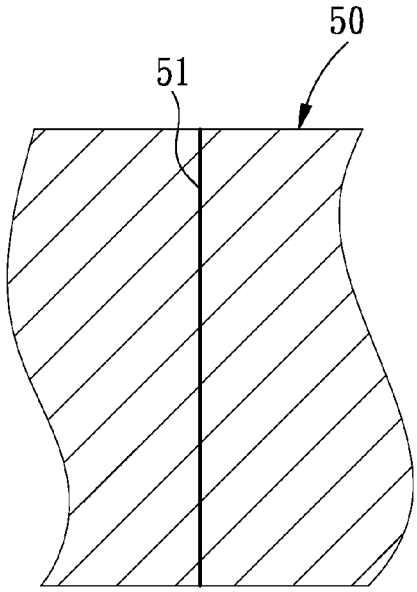
FIG. 5 is an illustrative view showing that the aperture in the non-permeable resilient body of the paint applicator in accordance with the present invention is closed.

In normal conditions, when the non-permeable resilient body 50 is not under pressure, the apertures 51 of the non-permeable resilient body 50 are closed, as shown in FIG. 5.

Figure 6:
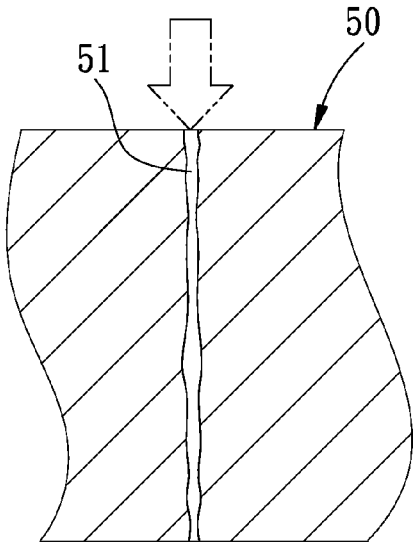
FIG. 6 is an illustrative view showing that the aperture in the non-permeable resilient body of the paint applicator in accordance with the present invention is opened.
Figure 7:
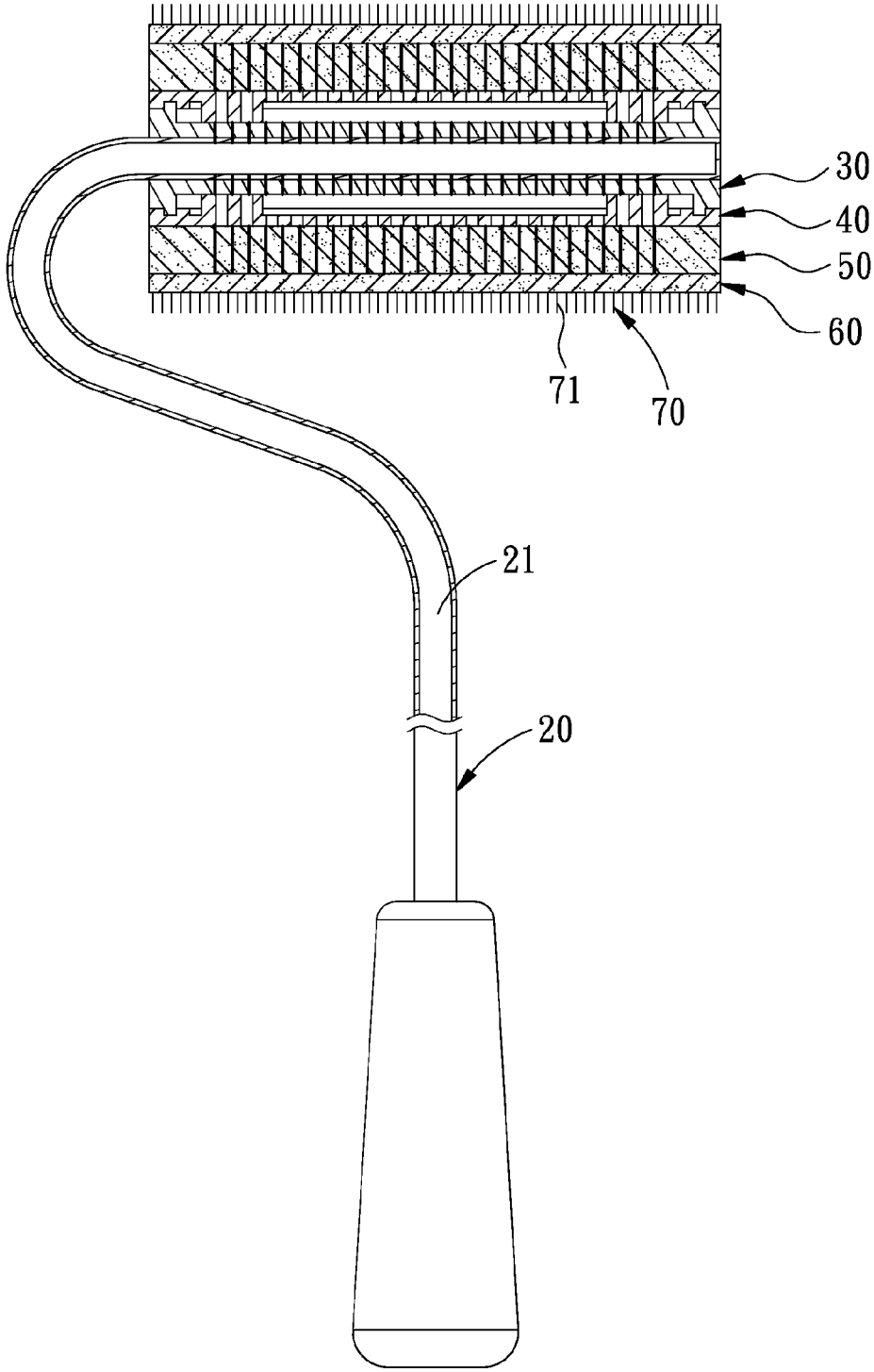
FIG. 7 shows another embodiment the paint applicator in accordance with the present invention.

In use, paint is poured into the paint chamber A via the paint-entry passage 21, and reserved in the receiving concave 41 and the paint exit holes 411. At this moment, the paint inside the second housing half 40 has a paint pressure with respect to the non-permeable resilient body 50, and the paint pressure is proportional to the weight and flow rate of the paint poured. Hence, when the paint is continuously poured in and the weight of the paint poured into the second housing half 40 continuously increases, namely, the paint pressure synchronously increases, so that when the paint pressure is greater than a deformation threshold value of the non-permeable resilient body 50, the non-permeable resilient body 50 will produce elastic deformation, as shown in FIG. 6, so that the apertures 51 will be deformed and therefore opened under pressure. Therefore, paint from the paint exit holes 411 of the second housing half 40 can permeate into the apertures 51 and flow to the permeable foamed body 60 and the brush layer 70.

With the arrangement of the paint exit holes 411 and the apertures 51, paint can be accumulated in the paint chamber A, and then will flow out only when the paint pressure is greater than the deformation threshold value of the non-permeable resilient body 50. Furthermore, since the apertures 51 of the non-permeable resilient body 50 are very small and can therefore be evenly and densely distributed over the non-permeable resilient body 50, paint will be evenly permeated to the permeable foamed body 60 and the brush layer 70.

It is clear from above that the amount of paint released is proportional to paint pressure, so that the amount of the paint released can be controlled by controlling the weight or flow rate of the paint poured, consequently improving the operability of the paint applicator.

To summarize, the arrangement of the paint exit holes 411, the apertures 51 and the permeable foamed body 60, paint can be applied more uniformly, and the operability of the paint applicator can be improved.

In addition to the flat paint brush, the paint applicator of the present invention can also be in the form of a paint roller, wherein the first housing half 30, the second housing half 40, the non-permeable resilient body 50, the permeable foamed body 60 and the brush layer 70 are cylindrical-shaped.

While we have shown and described various embodiments in accordance with the present invention, it is clear to those skilled in the art that further embodiments may be made without departing from the scope of the present invention.

What is claimed is:

1. A paint applicator capable of controlling amount of paint released comprising:

a handle formed with a paint-entry passage that extends along a length thereof;

a first housing half connected to an end of the handle;

a second housing half jointed to the first housing half and formed with a receiving concave that cooperates with the first housing half to form a paint chamber, and at a bottom of the receiving concave being formed a plurality of paint exit holes;

a non-permeable resilient body disposed on the second housing half and formed with a plurality of apertures which are 0.005-0.01 cm in diameter, the apertures being closed in normal conditions and abutted against the paint exit holes of the second housing half, the non-permeable resilient body being deformable only when a pressure applied to the non-permeable resilient body is greater than a deformation threshold value;

a permeable foamed body abutted against the non-permeable resilient body; and a brush layer abutted against the permeable foamed body.

2. The paint applicator capable of controlling amount of paint released as claimed in claim 1, wherein the non-permeable resilient body is a foamed body, and the brush layer is composed of a plurality of bristles.

* * * * *